US005975530A

United States Patent [19]

Gary

[11] Patent Number: 5,975,530

[45] Date of Patent: Nov. 2, 1999

[54] DARTBOARD GOLF GAME

[76] Inventor: John R. Gary, 466 S. Holt Ave., Los Angeles, Calif. 90048

[21] Appl. No.: 09/088,282

[22] Filed: Jun. 2, 1998

[51] Int. Cl.[6] ..... F41J 3/00

[52] U.S. Cl. ..... 273/317.2; 273/408; 273/409

[58] Field of Search ..... 273/317.2, 403, 273/404, 407, 408, 409

[56] References Cited

U.S. PATENT DOCUMENTS

| | | | |
|---|---|---|---|
| D. 350,158 | 8/1994 | Daneault | D21/6 |
| 1,928,768 | 10/1933 | Sell et al. | 273/317.2 X |
| 3,697,073 | 10/1972 | Dooley | 273/95 R |
| 3,853,318 | 12/1974 | Cagan | 273/102.1 G |
| 3,979,117 | 9/1976 | Worsham | 273/102 B |
| 5,020,807 | 6/1991 | Barkley | 373/409 |
| 5,197,743 | 3/1993 | Hanson, Jr. | 273/378 |
| 5,553,850 | 9/1996 | Savo et al. | 273/317.2 |
| 5,558,337 | 9/1996 | Frank, III | 273/317.2 X |
| 5,642,886 | 7/1997 | Yancey, Jr. | 273/408 |

*Primary Examiner*—William H. Grieb
*Attorney, Agent, or Firm*—Goldstein & Canino

[57] ABSTRACT

A golf dart game played upon a circular playing field having a playing field center and having a plurality of hole wedges extending from the playing field center. The hole wedges are divided into sections which include hazard sections and desired sections. Hole indicia numbered one through eighteen is located adjacent to each of the hole wedges, so that each hole wedge is assigned a distinct sequential hole number. The game is played in rounds, wherein each round is associated within a particular hole wedge, known as the current hole wedge. The player throws three darts per round, and aims them at the desired sections in the current hole wedge. Points are accumulated by landing darts on the desired sections. Points may be deducted when darts land on hazard sections or outside the current hole wedge. Points from all rounds are tabulated to determine a winner.

7 Claims, 4 Drawing Sheets

DARTBOARD GOLF GAME

BACKGROUND OF THE INVENTION

The invention relates to a dartboard golf game. More particularly, the invention relates to a game which is played upon a dartboard, in which the dartboard is arranged and the rules are made so as to capture the spirit of the game of golf.

Golf is perhaps one of the most sought after sports. More people dream about playing golf than actually play golf. People who are fascinated by golf are either constantly wishing they had the time to play, had the money to play, or had the skill to play. Even people who seek to engage in the game of golf must first spend considerable time and effort to simply develop their swing, before they can even play the game.

In recent years, computer golf games have preyed upon the desire of the non-golfer to play the game. They are also targeted at the golfer who would rather be at the golf course, but must settle for the computer. Computer golf games have been developed which realistically depict the golf course with photo-realistic three dimensional images. They realistically illustrate a digitized golfer taking a swing, and the ball traveling down the fairway, obeying all the laws of physics and influenced by a simulated wind. However realistic the game is depicted on the computer screen, it requires very little skill of any kind to play. Human interaction is limited to selecting a club, and pressing a few keys to initiate the swing. Thus, computerized golf is more about learning the peculiarities of the program, and then making mental decisions about how to achieve the best results, than about developing any sort of physical skill.

U.S. Pat. No. 5,197,743 discloses a golfing dart game apparatus in which an aerial view of an 18 hole golf course is depicted. Because of the small space attributed to each hole, it seems extremely difficult to play, and would probably be quite frustrating for the beginner.

U.S. Pat. No. 5,020,807 to Barkley discloses a dart board which simulates a golf course. Barkley depicts a nine hole golf course.

U.S. Pat. No. 3,697,073 to Dooley discloses a golf photography dart board game, in which different images of a golf course are projected onto a screen at which the player throws darts. Dooley is quite complicated, and would be cost prohibitive to manufacture.

While these units may be suitable for the particular purpose employed, or for general use, they would not be as suitable for the purposes of the present invention as disclosed hereafter.

SUMMARY OF THE INVENTION

It is an object of the invention to produce a golf dart game which captures the spirit of the game of golf, while allowing play anywhere, at any time. Accordingly, a dart board is provided which is divided into eighteen sections, which each represent a hole on a golf course. the dart board is further arranged with features that depict a golf course. In addition, the rules of the game and are consistent with scoring rules of the actual game of golf.

It is another object of the invention that the golf dart game requires skill to play, and that further play will improve these skills. Accordingly, success at the golf dart game requires that the player develop dart throwing accuracy, and also develop strategy which that is particular to the golf dart game.

It is a further object of the invention that game play progresses quickly, much like traditional darts. Thus, each player is allowed three dart throws per round. The locations where these darts land, together determines the score achieved from that round for that player.

The invention is a golf dart game played upon a circular playing field having a playing field center and having a plurality of hole wedges extending from the playing field center. The hole wedges are divided into sections which include hazard sections and desired sections. Hole indicia numbered one through eighteen is located adjacent to each of the hole wedges, so that each hole wedge is assigned a distinct sequential hole number. The game is played in rounds, wherein each round is associated within a particular hole wedge, known as the current hole wedge. The player throws three darts per round, and aims them at the desired sections in the current hole wedge. Points are accumulated by landing darts on the desired sections. Points may be deducted when darts land on hazard sections or outside the current hole wedge. Points from all rounds are tabulated to determine a winner.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
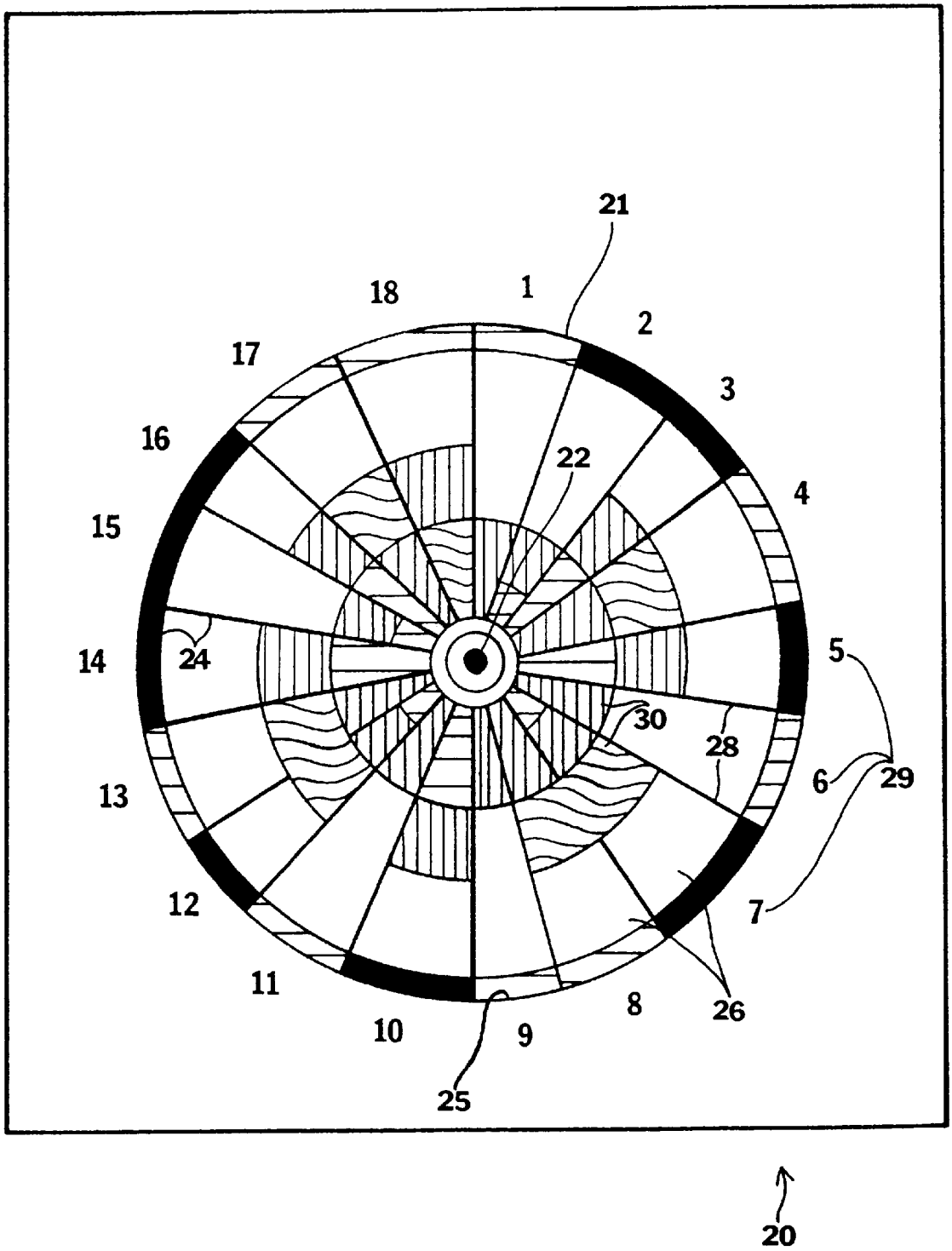
FIG. 1 is a top plan view, illustrating the golf dart board, per se.

FIG. 1 illustrates a golf dart board 20. The board 20 is made of cork, or a similar material, so that a dart having a dart point may be thrown at the dart board, wherein the dart point is retained in the board 20. The board 20 has a circular playing field 21, having a playing field center 22. The dart board has indicia 24 printed thereupon which includes a perimeter circle 25, concentric with the board center 22, and defining the playing field 21. The perimeter circle is divided into eighteen hole wedges 26, which are each defined by hole boundaries 28 which extend radially between the board center 22 and the perimeter circle 25.

Hole indicia 29 is located outside of the perimeter circle 25, adjacent to each of the hole wedges 26. The hole indicia 29 labels each of the hole wedges with a distinct hole number. The hole numbers are sequentially arranged in ascending order clockwise around the playing field 21.

The hole wedges 26 are not all equal in size. Each hole wedge has a wedge angle which is formed between its hole boundaries 18. The wedge angle varies for the different hole wedges. The hole wedges are classified in size as par threes, par fours, and par fives. All of the par threes are the same size, all of the par fours are the same size, and all of the par fives are the same size. Preferably, each of the par threes should represent approximately 4.2% of the circle, each of the par fours should represent approximately 5.6% of the circle, and each of the par fives should represent approximately 6.9% of the circle.

Figure 2:
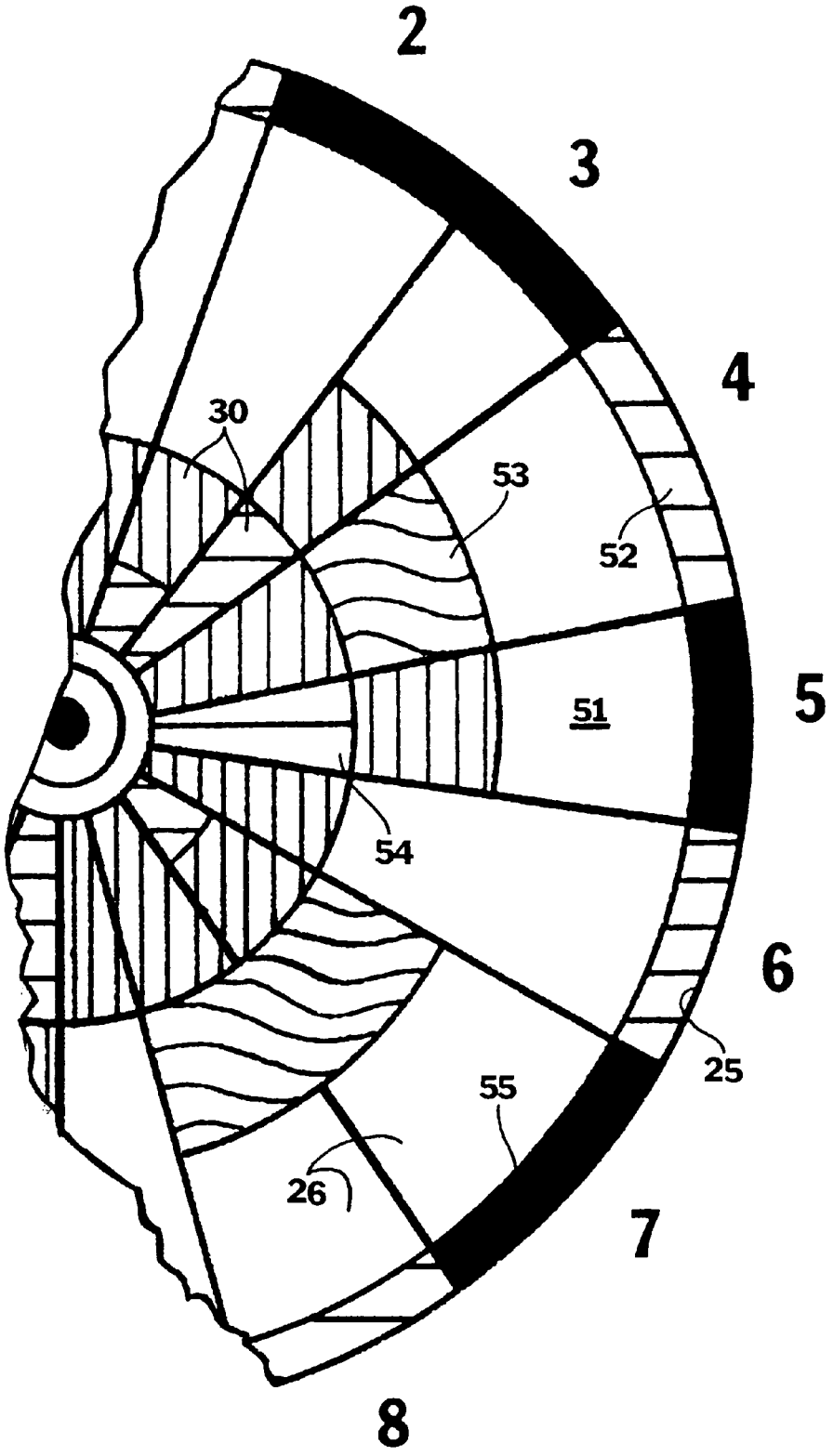
FIG. 2 is a top plan view, which is an enlargement of one are of the golf dart board.

Each hole wedge 26 is divided into sections 30. Each section has scoring significance. FIG. 2 is an enlarged view, in which the sections 30 contained within a group of the hole wedges 16 are clearly indicated. The sections are each indicated in the drawing figures, and to the players using a like shading pattern or color scheme. The sections 30 include par 51, eagle 52, lake 53, birdie 54, and out of bounds 55. All hole wedges 16 contain desired sections, which include the eagle 52, birdie 54, and par 51 sections. Some of the hole wedges 16 also have hazard sections, which include the lake 53 and out of bounds 55 sections.

Different manners of game play are possible with the golf dart board 10 as described. However, one preferred manner of game play is described as follows.

When the golf dart game is played by two or more players, each round of play is directed at one of the hole wedges 26. Thus, a full game comprises eighteen rounds. During each round, each player is given three darts. The darts are aimed at a current hole, which is one of the hole wedges. Each round results in a score which is either positive, negative, or zero. After all holes are played, the winner is determined by tabulating the scores from all of the rounds.

During each round, the player is given three darts, which the player then attempts to throw the dart at the desired sections within the current hole, which are the birdie 54, eagle 52 or par 51 sections. While aiming at the desired sections, the player also tries to avoid landing one of the darts on the hazard sections, or to miss the current hole entirely and land the dart on another hole wedge, or outside the perimeter circle 25.

If one of the darts land on the birdie 54 or eagle sections, a positive score is achieved. Landing the dart on the par section has no effect on the score. Landing the dart in the lake 53 and out of bounds 55 sections, or outside of the current hole wedge might have a negative effect on the score.

Preferably, the game is played such that if one of the darts lands on eagle or birdie, then the positive score achieved therefrom is "protected". Then, landing the other darts on the out of bounds 55 section or outside of the current hole wedge has no negative effect on the score. Further, landing on par 51 protects the neutral score, preventing point deductions from subsequent throws that round.

In the absence of a protected throw, the game is played so that if one dart lands on the out of bounds 55 section, or outside the current hole wedge, then no score deduction is made. However, if more than one dart lands on the out of bounds 55 section, or outside the current hole wedge, then a score deduction is made. Landing on the lake 53 section will result in a point deduction.

Preferably, the point additions and deductions are as follows. A one point deduction is made when a dart lands on the lake 53 section. A one point deduction is made when two darts land in the out of bounds 55 section or outside of the current hole wedge. A two point deduction is made when all three darts land in the out of bounds 55 section or outside the current hole wedge. Two points are added when a dart lands on the birdie 54 section. Five points are added when a dart lands on the eagle 52 section. Eight points are added when two darts land on the eagle 52 section.

Figure 3:
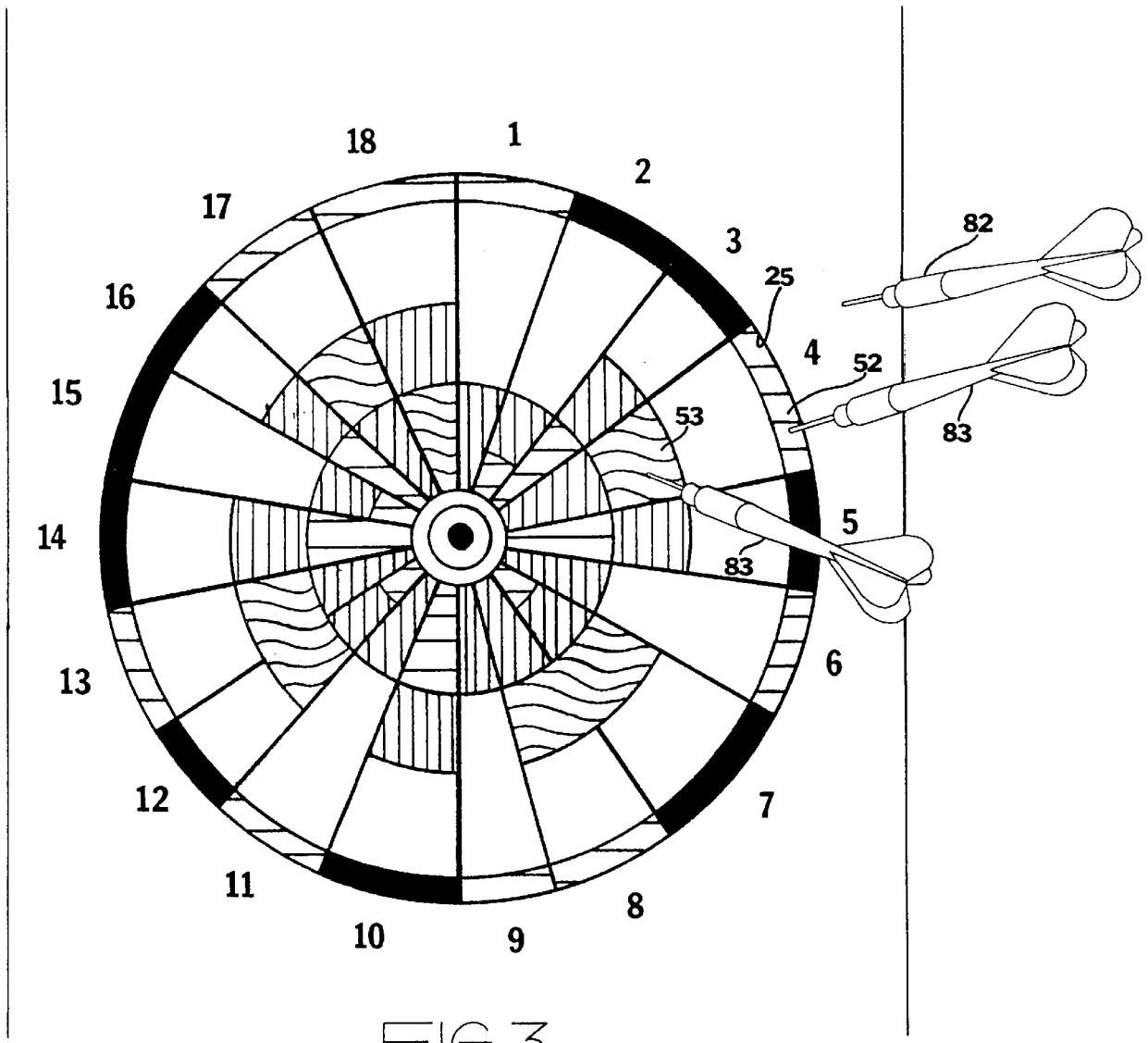
FIG. 3 is a top plan view, similar to FIG. 1, illustrating a grouping of three darts upon the board.

FIG. 3 illustrates a sample round, wherein the current hole is hole number four, and wherein a first dart 81, second dart 82, and third dart 83 have been thrown. The first dart 81 landed in the eagle 52 section. Although, the second dart 82 landed outside the perimeter circle 25 and the third dart 83 landed in the lake 53, no points are deducted for the second dart 82 and third dart 83. The score was "protected" by the first dart 81 landing in the eagle section 52. Thus, the score for this round is plus five.

Figure 4:
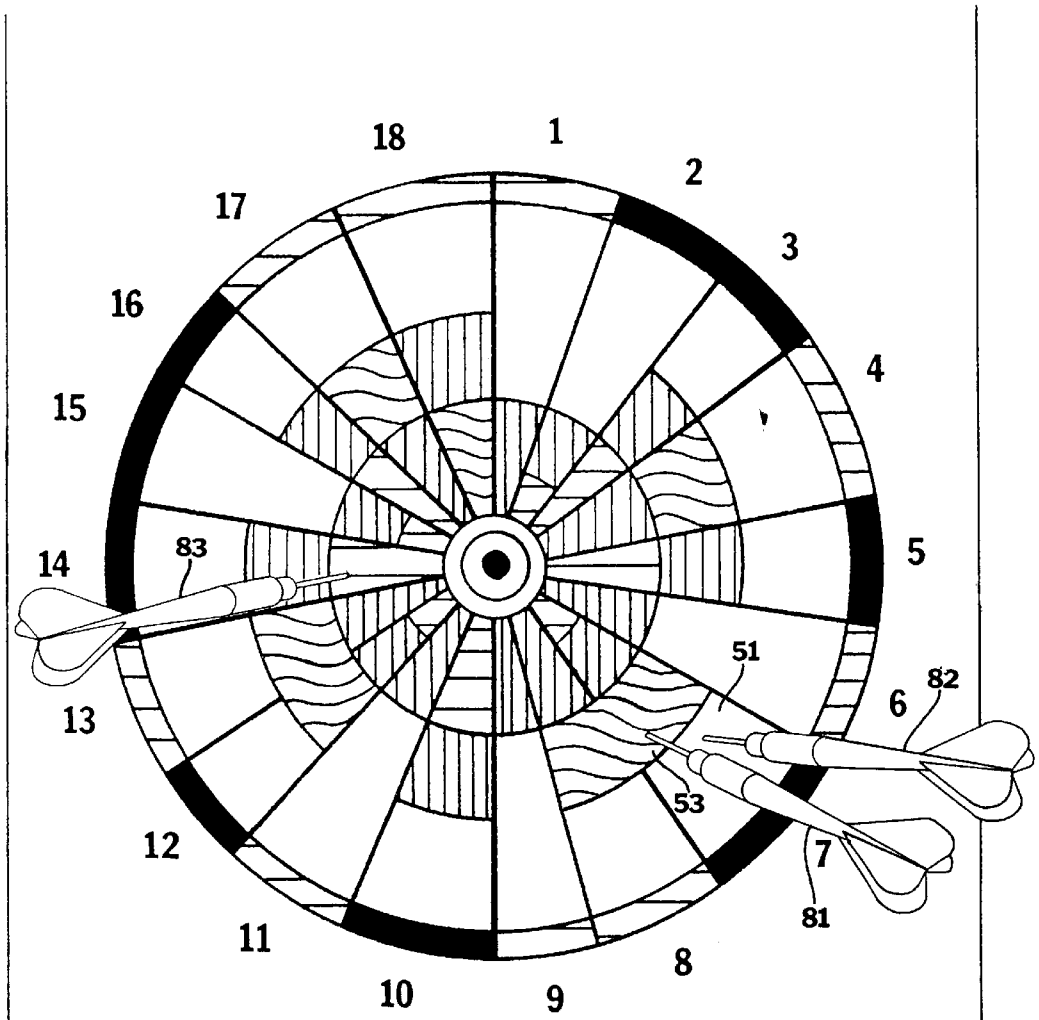
FIG. 4 is a top plan view, similar to FIG. 2, illustrating another grouping of three darts upon the board.

FIG. 4 illustrates another sample round, wherein the current hole is hole number seven, and the first dart 81, second dart 82, and third dart 83 have been thrown. The first dart 81 landed in the lake section 53. One point is deducted for this throw. The second dart 82 lands in the par section 51. No point value is achieved for this throw. the third dart 83 lands in a hole wedge other than the current hole wedge. However, no point deduction is made for this throw, because the throw was protected by the previous par throw. Thus, the overall score for this round is negative one.

In conclusion, herein is presented a golf dart game in which the dart board is arranged into eighteen radial wedges which extend from the board center. Each round is played with three darts which are all aimed at one particular hole wedge, which is known as the current hole wedge. The darts are aimed at desired sections of the wedge, which include par, eagle, and birdie sections. The player seeks to avoid throwing the dart at hazard sections such as lake and out of bound sections, or throwing the dart outside of the current hole wedge, which could result in point deductions. The scores from all rounds are tabulated to determine a winner.

What is claimed is:

1. A golf dart game method, played with a dart board having a circular playing field having a playing field center and a plurality of hole wedges extending from the playing field center, each wedge is divided into sections including desired sections and hazard sections, wherein a round of play is associated with one of the hole wedges which is a current hole wedge, and wherein said round of play further comprises the steps of:

throwing three darts;

tabulating a non-negative score for darts which land on the desired sections;

selectively deducting points for darts which land in the hazards; and selectively deducting points for darts which land outside of the current hole wedge.

2. The golf dart game method as recited in claim 1, wherein the desired sections include eagle, birdie, and par sections.

3. The golf dart game method as recited in claim 2, wherein the step of tabulating a non-negative score for darts which land on the desired sections further comprises: tabulating a positive score for darts that land on the birdie and eagle sections, and tabulating a zero score for darts that land on the par sections.

4. The golf dart game method as recited in claim 3, wherein if one of the darts lands on one of the desired sections, then the points are not deducted for darts which land in the hazards and darts which land outside of the current hole wedge.

5. The golf dart game as recited in claim 4, wherein the game board comprises eighteen wedges, each wedge having hole number indicia.

6. The golf dart game as recited in claim 5, wherein the current hole wedge for each round is determined by sequentially following the hole number indicia in ascending order.

7. The golf dart game as recited in claim 6, wherein the hole wedges are each classified as one of a par four, a par five, and a par six hole, and wherein the par four, par five, and par six holes are distinct sizes but all par four hole wedges are the same size, all par five hole wedges are the same size, and all par six holes wedges are the same size.

* * * * *